US008747179B2

(12) United States Patent
Nagai et al.

(10) Patent No.: US 8,747,179 B2
(45) Date of Patent: Jun. 10, 2014

(54) ROBOT TOY

(71) Applicant: Tomy Company, Ltd., Tokyo (JP)

(72) Inventors: Tomohito Nagai, Tokyo (JP); Ryoichi Sato, Matsudo (JP); Teruo Kitamura, Kokubunji (JP)

(73) Assignee: Tomy Company, Ltd., Tokyo (JP)

( * ) Notice: Subject to any disclaimer, the term of this patent is extended or adjusted under 35 U.S.C. 154(b) by 0 days.

(21) Appl. No.: 13/896,749

(22) Filed: May 17, 2013

(65) Prior Publication Data

US 2013/0252509 A1 Sep. 26, 2013

Related U.S. Application Data

(63) Continuation of application No. 13/695,513, filed on Oct. 31, 2012.

(51) Int. Cl.

| | |
|---|---|
| ***A63H 3/20*** | (2006.01) |
| ***A63H 11/00*** | (2006.01) |
| ***A63H 13/00*** | (2006.01) |
| ***A63H 13/06*** | (2006.01) |

(52) U.S. Cl.
USPC ..... 446/330; 446/335

(58) Field of Classification Search
USPC ..... 446/268, 269, 272, 276, 277, 294, 330, 446/333–336, 376, 484
See application file for complete search history.

(56) References Cited

U.S. PATENT DOCUMENTS

| | | | | |
|---|---|---|---|---|
| 2,641,864 | A * | 6/1953 | Villemejane | 446/293 |
| 2,761,243 | A * | 9/1956 | Baggott | 446/377 |
| 3,128,575 | A * | 4/1964 | Stanetzki | 446/355 |
| 3,332,165 | A * | 7/1967 | Losonczy et al. | 446/158 |
| 5,042,807 | A | 8/1991 | Sasakawa et al. | |
| 5,046,987 | A | 9/1991 | Djordjevic | |
| 5,100,138 | A | 3/1992 | Wilde | |
| 5,238,441 | A * | 8/1993 | Llorens | 446/288 |

(Continued)

FOREIGN PATENT DOCUMENTS

| | | |
|---|---|---|
| CN | 201235220 | 5/2009 |
| DE | 20 2005 001 923 | 5/2005 |

(Continued)

OTHER PUBLICATIONS

Patent Abstracts of Japan, Publication No. 06-327843, Published Nov. 29, 1994.

(Continued)

*Primary Examiner* — Gene Kim
*Assistant Examiner* — Alyssa Hylinski
(74) *Attorney, Agent, or Firm* — Staas & Halsey LLP

(57) ABSTRACT

A robot toy includes a body and a controller. The body includes right and left arms, legs, arm-actuating mechanisms, thrust mechanisms, and a driving unit. The arms can be extended forward and back, and are pulled back by a predetermined biasing force in a normal condition. The arm-actuating mechanisms are provided at the respective arms and allow the corresponding arms to be extended and pulled back. The thrust mechanisms are provided at the respective legs and allow the corresponding legs to move forward. The driving unit drives one of a pair of the left arm-actuating mechanism and the left thrust mechanism and a pair of the right arm-actuating mechanism and the right thrust mechanism. The driving unit simultaneously drives the arm-actuating mechanism and the thrust mechanism in the same pair.

6 Claims, 13 Drawing Sheets

(56) References Cited

U.S. PATENT DOCUMENTS

| | | | | |
|---|---|---|---|---|
| 5,290,185 | A * | 3/1994 | Murakami | 446/334 |
| 5,355,064 | A | 10/1994 | Yoshino et al. | |
| 5,458,523 | A | 10/1995 | Aoki et al. | |
| 5,727,982 | A | 3/1998 | Hurt | |
| 5,732,953 | A | 3/1998 | Tamura | |
| 6,022,263 | A | 2/2000 | Liu et al. | |
| 6,106,359 | A | 8/2000 | Arriola | |
| 6,280,286 | B1 | 8/2001 | Andrews | |
| 6,296,543 | B1 * | 10/2001 | Andrews | 446/334 |
| D459,412 | S | 6/2002 | Fong | |
| D461,856 | S | 8/2002 | Fong | |
| 6,505,096 | B2 | 1/2003 | Takenaka et al. | |
| 6,589,095 | B1 | 7/2003 | Tsai | |
| 6,626,731 | B2 | 9/2003 | Marine | |
| 6,672,935 | B1 | 1/2004 | Lund et al. | |
| 6,674,259 | B1 | 1/2004 | Norman et al. | |
| 6,736,693 | B1 | 5/2004 | Lund et al. | |
| 6,943,520 | B2 | 9/2005 | Furuta et al. | |
| 6,949,003 | B2 | 9/2005 | Hornsby et al. | |
| 6,992,456 | B2 | 1/2006 | Furuta et al. | |
| 7,193,384 | B1 | 3/2007 | Norman et al. | |
| 7,475,881 | B2 | 1/2009 | Blagg et al. | |
| 7,654,881 | B2 | 2/2010 | Nakazato et al. | |
| 7,734,375 | B2 | 6/2010 | Buehler et al. | |
| 2001/0047226 | A1 * | 11/2001 | Saijo et al. | 700/261 |
| 2002/0193045 | A1 * | 12/2002 | Lee et al. | 446/330 |
| 2003/0017779 | A1 * | 1/2003 | Sakai | 446/226 |
| 2004/0198160 | A1 | 10/2004 | Fong | |
| 2010/0048092 | A1 | 2/2010 | Kenney | |
| 2010/0174410 | A1 | 7/2010 | Greer et al. | |
| 2010/0311304 | A1 | 12/2010 | Jang et al. | |

FOREIGN PATENT DOCUMENTS

| | | |
|---|---|---|
| EP | 1 938 877 | 7/2008 |
| JP | 6-26992 | 4/1994 |
| JP | 6-210073 | 8/1994 |
| JP | 6-327843 | 11/1994 |
| JP | 2701121 | 11/1994 |
| JP | 06327843 A * | 11/1994 |
| JP | 3006324 | 1/1995 |
| JP | 2000-116965 | 4/2000 |
| WO | 2005/061069 | 7/2005 |

OTHER PUBLICATIONS

International Search Report of Corresponding PCT Application PCT/JP2012/052146 mailed Jan. 31, 2012.

Search Results (44 pages).

U.S. Appl. No. 13/695,513, filed Oct. 31, 2012, Tomohito Nagai et al., Tomy Company, Ltd.

English translation of International Search Report dated Oct. 2, 2013 in PCT/JP2012/052146.

Espacenet English Abstract of Chinese Application No. 201235220 published May 13, 2009.

Extended European Search Report dated Jan. 7, 2014 in appln. No. 12775595.7.

* cited by examiner

ROBOT TOY

CROSS-REFERENCE TO RELATED APPLICATIONS

This application is a continuation application and claims the benefit under 35 U.S.C. §120 of co-pending U.S. application Ser. No. 13/695,513, filed Oct. 31, 2012, entitled "Robot Toy", which is hereby incorporated by reference in its entirety into this application, and which co-pending application was designated in International Application Serial No. PCT/JP2012/052146, filed Jan. 31, 2012, and the entry of the U.S. National Phase for which has been successfully completed.

TECHNICAL FIELD

The present invention relates to a robot toy.

BACKGROUND ART

Conventionally, robot toys have been known that are configured so that the robot-toy body moves forward in association with the movement in play fighting (For example, Patent Literature 1).

In such a robot, when the torso of the body is rotated, its arms are rotated in conjunction with it. When the rotation impact force produced by the stopping is transmitted to the hip, from which legs extend. Guidance wheels disposed at the toes of the legs, in turn, move the lower body along its inertial force, enabling the body to move forward.

Patent Literature 1: Japanese Patent No. 2701121

The robot toy disclosed in Patent Literature 1 is configured so that a robot-toy body moves forward by the impact force produced in stopping the rotation of the torso. This configuration makes it difficult to control the direction in which the body moves. Thus, when two toy robots are to fight in a match, it is difficult to make the two bodies face each other.

SUMMARY OF THE INVENTION

It is an object of the present invention to provide a robot toy which enables easy control of the moving direction of the robot-toy body.

To satisfy this and other objects, thus is provided herein a robot toy including: a robot-toy body including a control unit; and a controller which remotely controls the robot body via the control unit, the robot-toy body including: right and left arms each connected to a torso, wherein states of each of the right and left arms include a state of being extended forward and being pulled back, and wherein each of the right and left arms is pulled back by a predetermined biasing force in a normal condition; right and left legs each connected to a hip; right and left arm-actuating mechanisms provided at the right and left arms, respectively, wherein each of the arm-actuating mechanisms allows the corresponding arm to be extended in front of the robot-toy body against the biasing force; right and left thrust mechanisms provided at the right and left legs, respectively, wherein each of the thrust mechanisms allows the corresponding leg to push a support, e.g., a floor so that the leg moves forward; and a driving unit which selectively and simultaneously drives a pair of the left arm-actuating mechanism and the left thrust mechanism and a pair of the right arm-actuating mechanism and the right thrust mechanism.

Each of the right and left arms includes an upper arm and a lower arm which are bent and stretched with respect to each other; when the right and left arms are pulled back, the upper arm and the lower arm of each of the right and left arms are bent with respect to each other, so that the robot-toy body assumes a ready position; and when one of the right and left arms is extended forward, the upper arm and the lower arm of the extended arm are stretched with respect to each other, so that the robot-toy body assumes a punching position.

Each of the thrust mechanisms includes: a lever extending vertically in an interior of the corresponding leg, the lever being supported rotatably with a shaft in the middle of the lever such that a bottom end portion of the lever moves back and forth; a wheel provided at the bottom end portion of the lever; and a clutch mechanism which locks the wheel when the bottom end portion of the lever moves backward, and which releases the wheel when the bottom end portion of the lever moves forward, and wherein a movement of the lever allows the corresponding leg to move forward.

The driving unit includes a rotary board which is rotatable about a shaft vertically extending just below the torso, the rotary board including right and left lever-operation touching units corresponding to the right and left levers, respectively; and when one of the right and left levers is touched by the corresponding lever-operation touching unit, the touched lever moves.

Each of the arm-actuating mechanisms includes a four-bar linkage mechanism having a supporting unit which supports the upper arm; the upper arm; the lower arm; and a link disposed between the supporting unit and the lower arm, and wherein one of the upper arm and the link serves as an input link; the rotary board includes right and left input-link-operation touching units corresponding to the right and left input links, respectively; and when one of the right and left input links is touched by the corresponding input-link-operation touching unit, the touched input link moves.

The predetermined biasing force is the arm's own weight; and, in the normal condition, the robot-toy body assumes the ready position wherein each of the right and left arms is bent due to its own weight.

The thrust mechanism pushes the floor, and the leg on the same side as the arm that has thrown a punch moves forward. As a result, the moving direction of the robot-toy body can be controlled easily.

When the bottom end portion of the lever moves from the front to the back, the wheel is locked. As a result, the robot-toy body can effectively move forward by pushing against the floor. On the other hand, when the bottom end portion of the lever moves from the back to the front, the wheel is released and rolls, which halts the robot-toy body. Thus, the advance movement of the robot-toy body is ensured.

The rotary board rotates about the shaft which extends vertically just below the torso. Thereby, the lever moves by being touched by the lever-operation touching unit formed on the periphery of the rotary board. As a result, one push of the lever allows the robot-toy body to move forward by a long distance.

The rotary board actuates not only the thrust mechanism but also the arm actuating mechanism, which allows the structure of the driving unit to be simple.

The body assumes a ready position where the left and right arms are bent due to their own weights in a normal condition. This eliminates the need for a biasing means, such as a spring, to make the ready position, which allows the structure of the robot-toy body to be simple.

DESCRIPTION OF THE EMBODIMENTS

Figure 1:
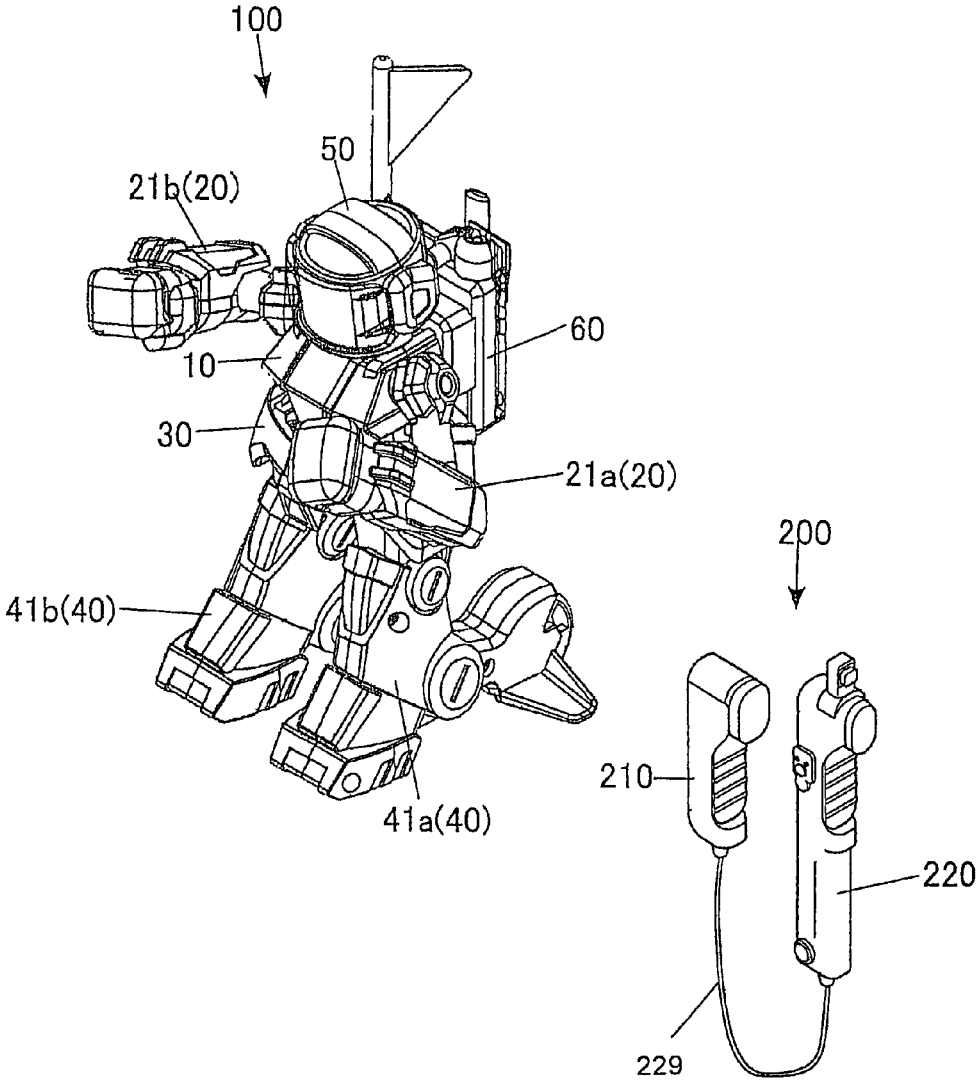
FIG. 1 is a perspective view of an embodiment of a robot toy according to the present invention.

A robot toy of the present invention will now be described based on embodiments shown in the drawings.

1. Overall Configuration of the Robot Toy

The robot toy includes a robot-toy body 100 and a controller 200. The robot-toy body 100 assumes a ready position in a normal condition.

With this robot toy, the robot-toy body 100 is moved by shaking a left operating unit 210 and a right operating unit 220 of the controller 200.

The actual operation of the robot toy will now be described. With the robot-toy body 100, when the left operating unit 210 of the controller 200 is shaken, the robot-toy body 100 actively moves forward its left leg 41*a* alone, and at the same time, throws an uppercut with a left arm 21*a*. Subsequently, the left arm 21*a* returns to its original position due to its own weight On the other hand, when the right operating unit 220 of the controller 200 is shaken, the robot-toy body 100 actively moves forward its right leg 41*b* alone, and at the same time, throws a hook with a right arm 21*b*. Subsequently, the right arm 21*b* returns to its original position due to its own weight.

In order to play fighting, a plurality of such robot toys are used.

If the robot-toy body 100 gets a punch in the face, a jaw of a head 50 drops, and the color of the head 50 changes in accordance with the number of punches that the body gets. If the robot toy gets a predetermined number of punches, the robot-toy body 100 automatically halts. In this case, after a user keeps the jaw of the head 50 held down for a predetermined time, the robot-toy body 100 is reactivated.

Details of the robot toy will now be described hereinafter.

2. Configuration of Body 100

(1) Overall Configuration

Figure 2:
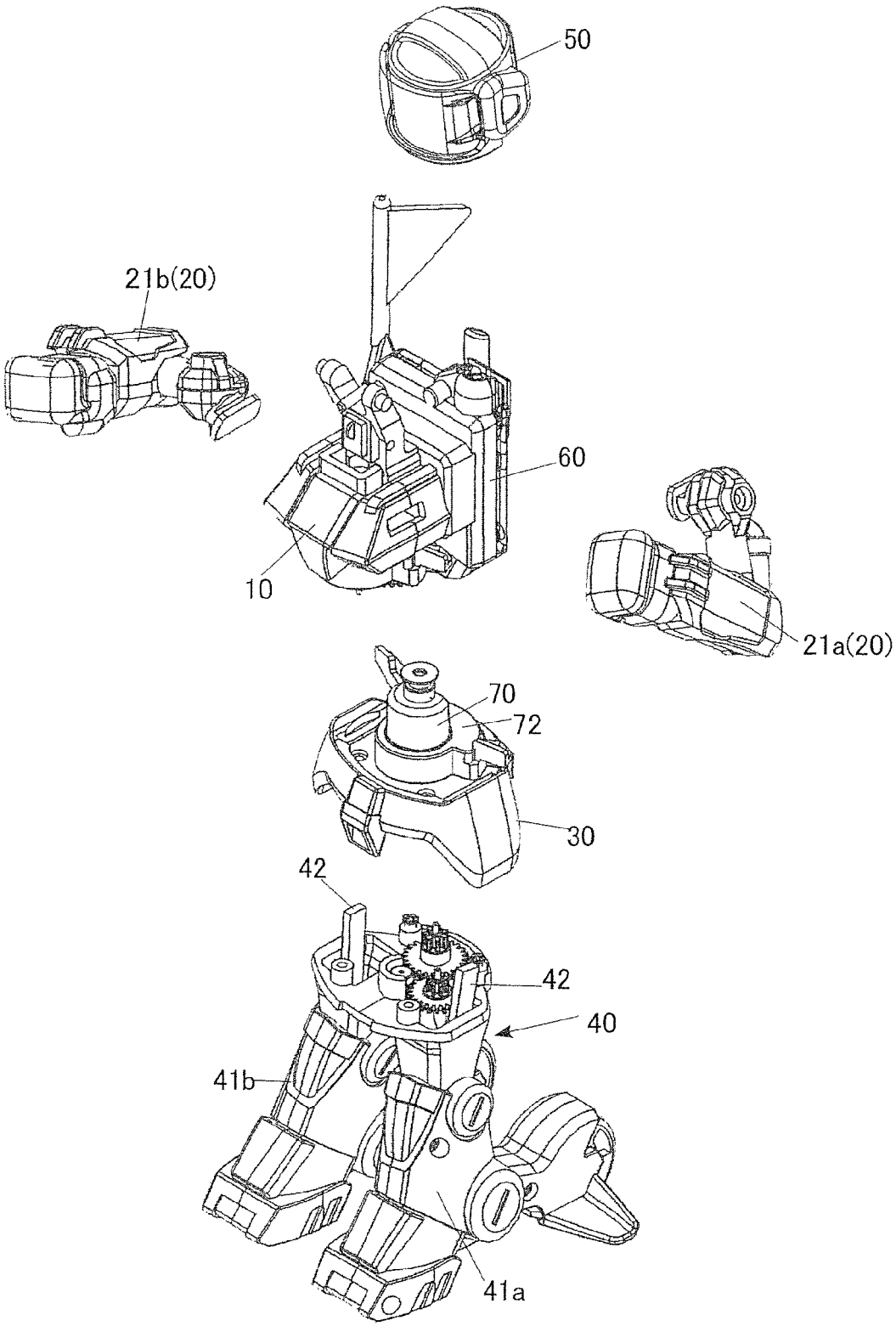
FIG. 2 is an exploded perspective view of the body of the robot toy shown in FIG. 1.

As shown in FIG. 2, the robot-toy body 100 includes a torso 10, arms 20, a hip 30, legs 40 and the head 50. The torso 10, the hip 30, and the legs 40 are connected to each other. A back board 60 of the torso 10 includes a battery and a circuit board with various circuit components. The head 50 is connected to the torso 10.

(2) Arms 20 and Arm-Actuating Mechanism A

The left arm 21*a* and the right arm 21*b* are connected to the torso 10. The left arm 21*a* and the right arm 21*b* substantially have the same configurations; therefore, they are described in reference to the same reference numerals hereinafter unless otherwise noted.

Figure 3:
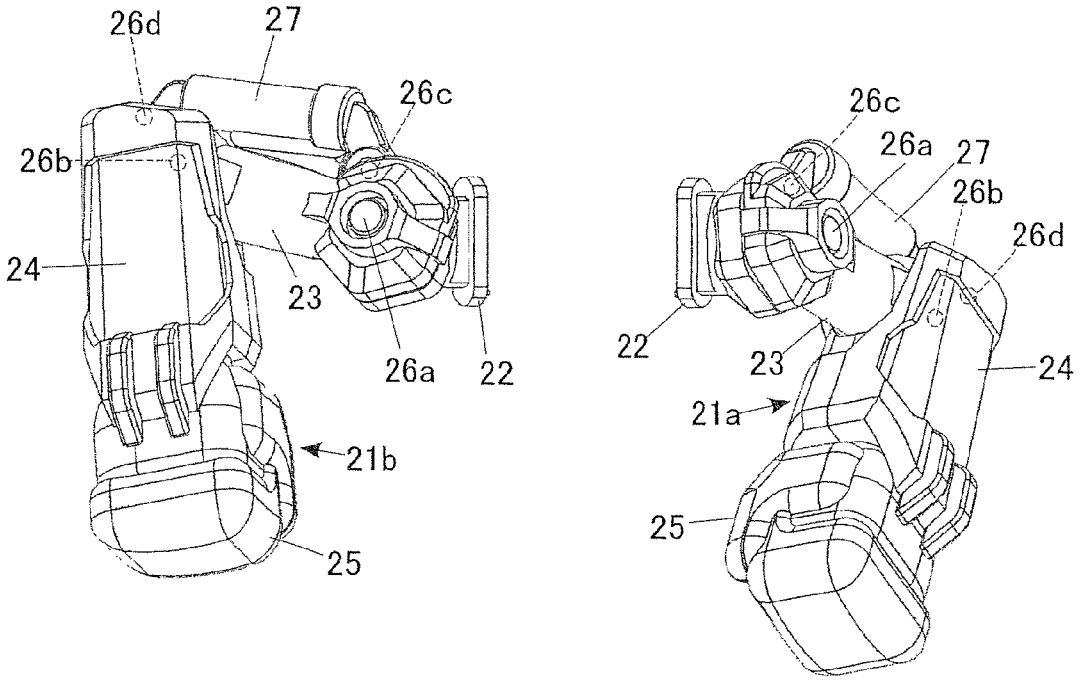
FIG. 3 is a perspective view of right and left arms of the robot-toy body shown in FIG. 2.

As shown in FIG. 3, the left arm 21*a* and the right arm 21*b* each include an arm base (supporting unit) 22, an upper arm 23, a lower arm 24, and a fist 25. The fist 25 is attached to the end of the lower arm 24.

The arm base 22 is fixed to the side of the torso 10.

A base end portion of the upper arm 23 is fixed to the arm base 22 through a shaft 26*a*, whereby the upper arm 23 can rotate about the shaft 26*a*.

A base end portion of the lower arm 24 is connected to another end of the upper arm 23 through a shaft 26*b*, whereby the lower arm 24 can rotate about the shaft 26*b*.

A base end portion of a link 27 is connected to the arm base 22 through a shaft 26*c* so that the base end portion of the link 27 is disposed away from the shaft 26*a*. Another end of the link 27 is connected to a part of the lower arm 24 through a shaft 26*d* so that the end of the link 27 is disposed away from the shaft 26*b*.

Preferably, a variety of interchangeable fists 25 with various weights may be prepared. In this case, a user may choose its style according to his/her preference. For example, a heavier fist 25 makes a strong punch but makes it hard to pound. On the other hand, a lighter fist 25 compromises the power of the punch but makes it easy to pound.

Alternatively, the length of the arms 20 may be varied. For example, the arms 20 may be detachably attached to the torso 10, and a variety of interchangeable arms 20 with various lengths may be prepared. In this case, a user may choose its style according to his/her preference. For example, long arms 20 keep a long distance from the other body 100 but make it hard to pound. On the other hand, short arms 20 keep only a short distance to the other body 100 but make it easy to pound.

The arm base 22, the upper arm 23, the lower arm 24, and the link 27 constitute an arm-actuating mechanism A that is a four-bar linkage mechanism. The link 27 serves as an input unit of the arm-actuating mechanism A.

Figure 4:
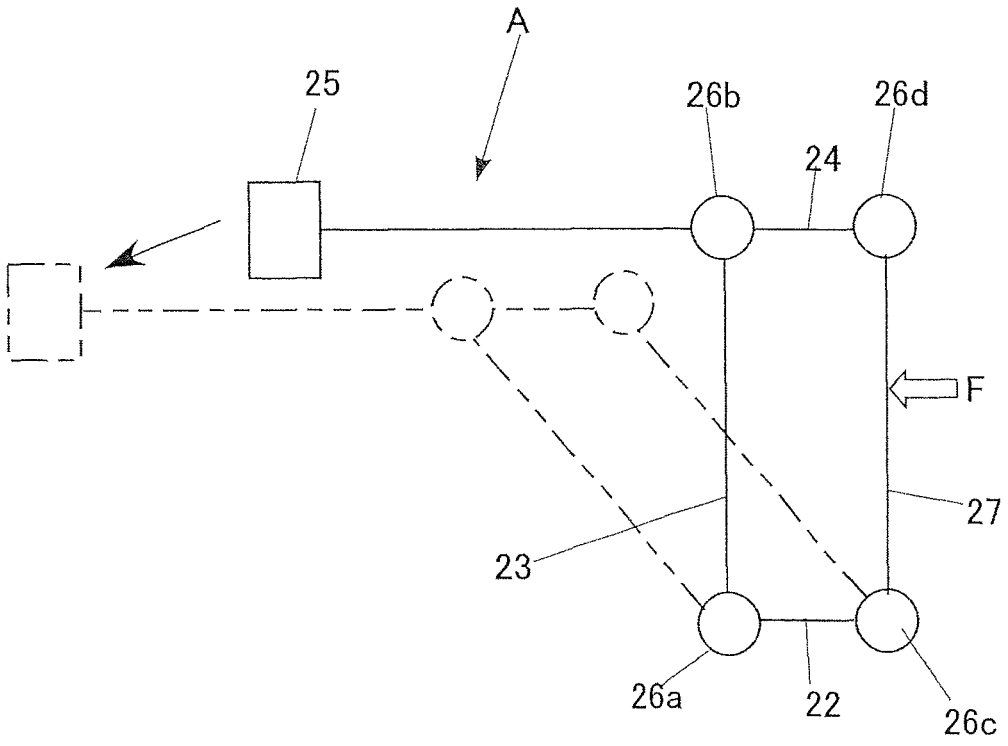
FIG. 4 is a schematic view of an arm-actuating mechanism of the robot-toy body shown in FIG. 2.

FIG. 4 schematically shows the arm-actuating mechanism A.

In the arm-actuating mechanism A, when a force F is applied to the link 27, the link 27 rotates about the shaft 26*c*, which actuates the upper arm 23 and the lower arm 24, thereby throwing a punch, as indicated by the two-dot chain line.

With the robot-toy body 100, a punch thrown by the left arm 21*a* and a punch thrown the right arm 21*b* are different from each other. After the robot-toy body 100 throws a punch, the left arm 21*a* and the right arm 21*b* return to their original position by their own weights.

Namely, the orientation of the arm base 22 and the initial positional relationship between the upper arm 23 and the lower arm 24 are determined such that the left arm 21*a* moves so as to throw an uppercut in boxing, and then returns to its original position by its own weight.

On the other hand, the orientation of the arm base 22 and the initial positional relationship between the upper arm 23 and the lower arm 24 are determined such that the right arm 21*b* moves so as to throw a hook in boxing, and then returns to its original position by its own weight.

With the present embodiment, the left arm 21*a* and the right arm 21*b* return to their original positions by their own weights. Alternatively, a spring may be used to bring the arms back.

3) Legs 40 and Thrust Mechanism B

The left leg 41*a* and the right leg 41*b* are fixed to the hip 30. The left leg 41*a* and the right leg 41*b* substantially have the same configurations; therefore, they are described in reference to the same reference numerals hereinafter unless otherwise noted.

Figure 5A:
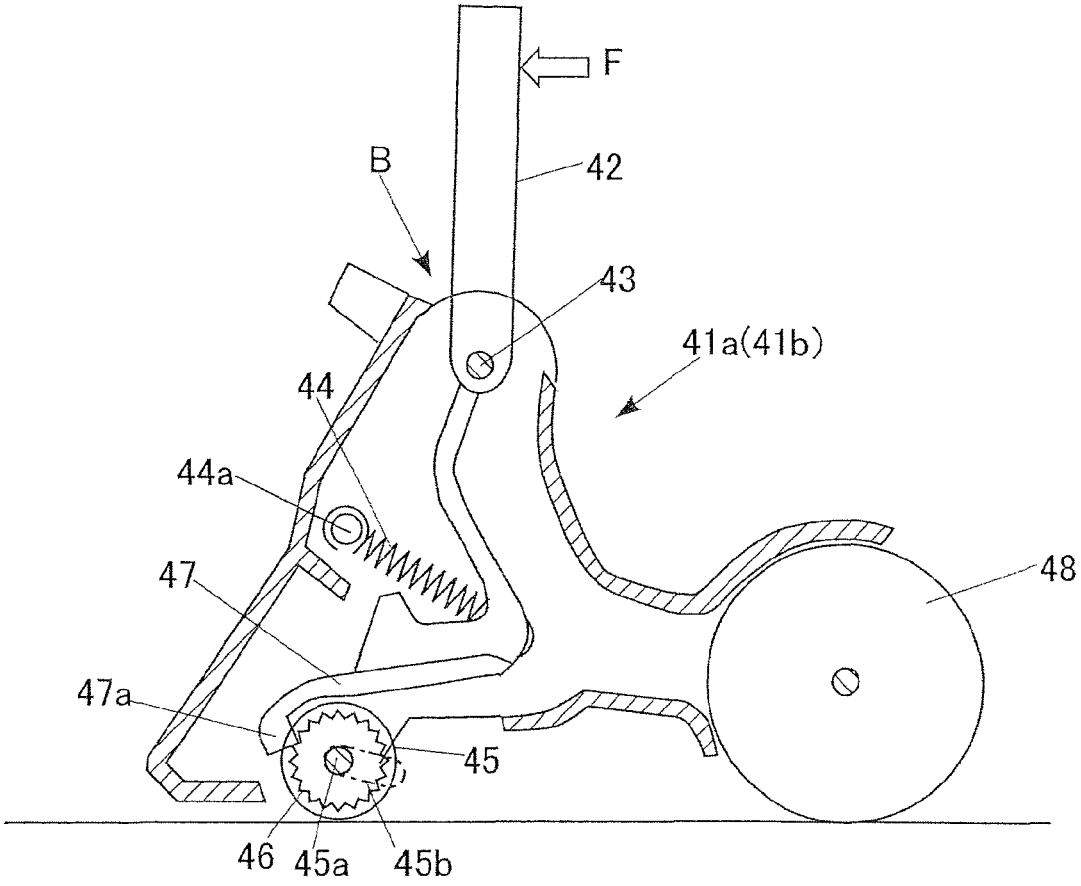
FIG. 5A is a cross-sectional view showing a state of a leg of the robot-toy body shown in FIG. 2 which starts moving.

As shown in FIG. 5A, a lever 42 is provided in each interior of the left leg 41*a* and the right leg 41*b*. The lever 42 extends from the vicinity of the sole of the left leg 41*a*/right leg 41*b* to just above the hip 30. The bottom half of the lever 42 is bent to form a depression which faces a front direction. The bottom half of the lever 42 has elasticity. The lever 42 can rotate about a horizontal shaft 43 disposed in the middle. The bottom half portion of the lever 42 is biased forwardly by a spring 44 disposed between the bottom part of the left leg 41*a*/right leg 41*b* and a fixing unit 44*a* of the left leg 41*a*/right leg 41*b*. The "bottom half" refers to the portion below the shaft 43 herein.

A front wheel 45 is fixed to the bottom half of the lever 42 such that the front wheel 45 partially protrudes from the sole of the left leg 41*a*/right leg 41*b*. A toothed wheel 46 is integrated with the front wheel 45 on the inner surface of the front wheel 45, and shares a shaft with the front wheel 45. A shaft 45*a* for the front wheel 45 and the toothed wheel 46 lies through an oblong opening 45*b* disposed at the bottom of the lever 42. The shaft 45*a* can shift and rotate within the oblong opening 45*b*.

A catch 47 is disposed at the bottom half of the lever 42. A click 47*a* of the catch 47 is disposed so as to face the toothed wheel 46.

Each of the left leg 41*a* and the right leg 41*b* is formed such that the heel portion extends backward. A rear wheel 48 is provided at the rear end of the extending heel portion. The rear wheel 48 is grounded. The rear wheel 48 helps to prevent the robot-toy body 100 from turning due to the impact from a punch, and helps the robot-toy body 100 to proceed straight forward to some extent. Preferably, a variety of interchangeable rear wheels with various weights may be prepared. In this case, a user can choose its style according to his/her preference. For example, a heavy rear wheel 48 makes a strong punch but the body moves slowly. On the other hand, a light rear wheel 48 makes a weakened punch, but the body moves quickly.

The thrust mechanism B is composed of the lever 42, the front wheel 45, the toothed wheel 46, and the catch 47. The top end of the lever 42 serves as an input unit of the thrust mechanism B.

The operation of the thrust mechanism B will now be described.

Figure 5B:
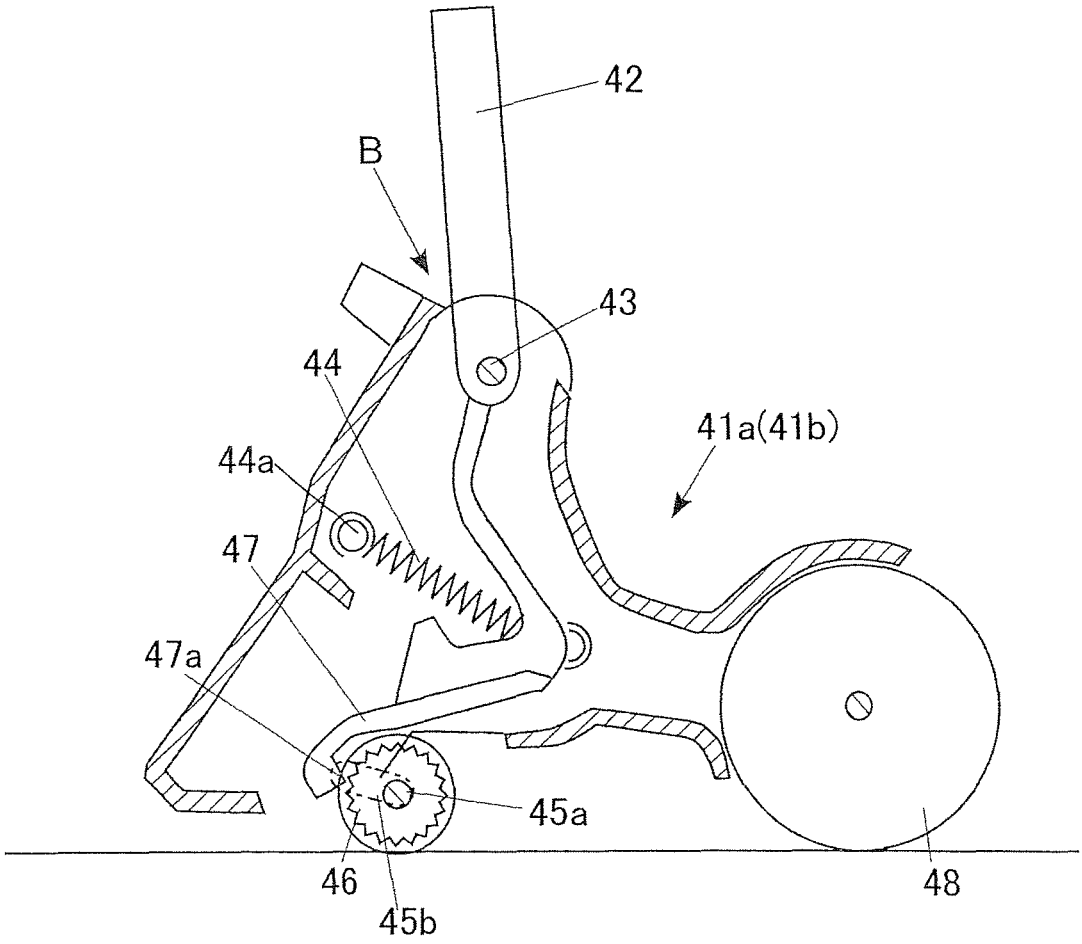
FIG. 5B illustrates a state of the leg of the robot-toy body shown in FIG. 2 which stops moving.

The initial position of the top end of the lever 42 is a rear position due to the biasing force of the spring 44 in the thrust mechanism B (See FIG. 5A). When a force F is applied to the top end of the lever 42 from the rear, the lever 42 rotates counterclockwise in the drawing about the shaft 43 against the biasing force of the spring 44. At this time, the front wheel 45 is strongly pushed against the floor, which shifts the shaft 45*a* of the front wheel 45 in a direction toward the click 47*a* of the catch 47 within the oblong opening 45*b*. Then, the click 47*a* of the catch 47 is engaged with a tooth of the toothed wheel 46, thereby locking the front wheel 45. As a result, the front wheel 45 pushes against the floor by the movement of the lever 42, whereby the leg corresponding to the lever 42 moves forward (See FIG. 5B).

Subsequently, when the force F applied to the top end of the lever 42 is eliminated, the lever 42 rotates clockwise in the drawing about the shaft 43 due to the biasing force of the spring 44. In this case, the oblong opening 45*b* allows the shaft 45*a* of the front wheel 45 to shift more slowly than the click 47*a* of the catch 47 does, whereby the click 47*a* of the catch 47 is disengaged from the tooth of the toothed wheel 46, and then the front wheel 45 is released. Consequently, the front wheel 45 rolls so that the leg corresponding to the lever 42 remains in the halting state.

Thus, the shaft within the oblong opening 45*b* supports the front wheel 45 and the toothed wheel 46, and the teeth of the toothed wheel 46 face the click 47*a* of the catch 47, which enables a one-way clutch mechanism, and the robot-toy body 100 can move effectively. The one-way clutch mechanism is not limited to the one illustrated in the drawing.

(4) Driving System C

Figure 6:
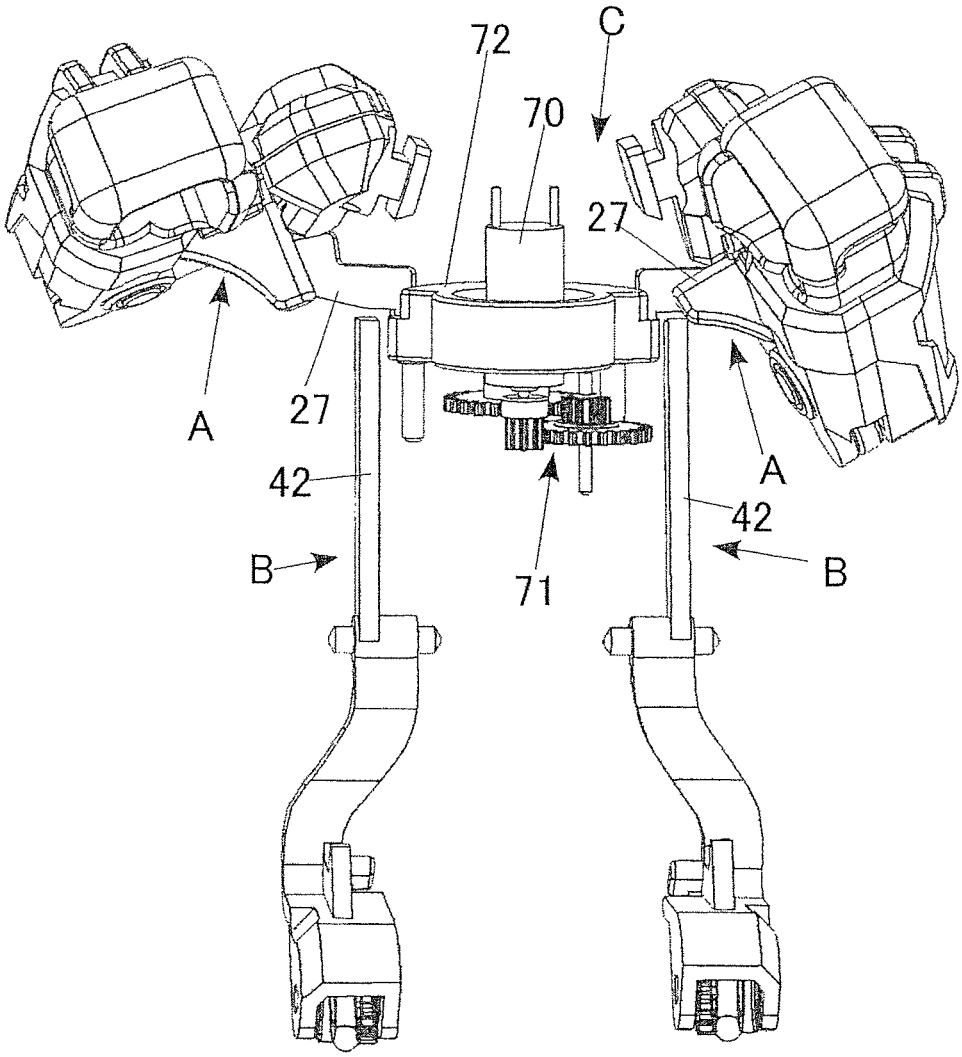
FIG. 6 is an elevation view of a driving unit, an arm-actuating mechanism, and a thrust mechanism of the robot-toy body shown in FIG. 2.

FIG. 6 is an elevation view showing the configuration of a driving unit C, the arm-actuating mechanism A, and the thrust mechanism B.

The driving unit C includes a motor 70 which can forwardly and reversely rotate. The motor 70 actuates the arm-actuating mechanism A and the thrust mechanism B via a gear array 71 and a rotary member or board 72.

Figure 7A:
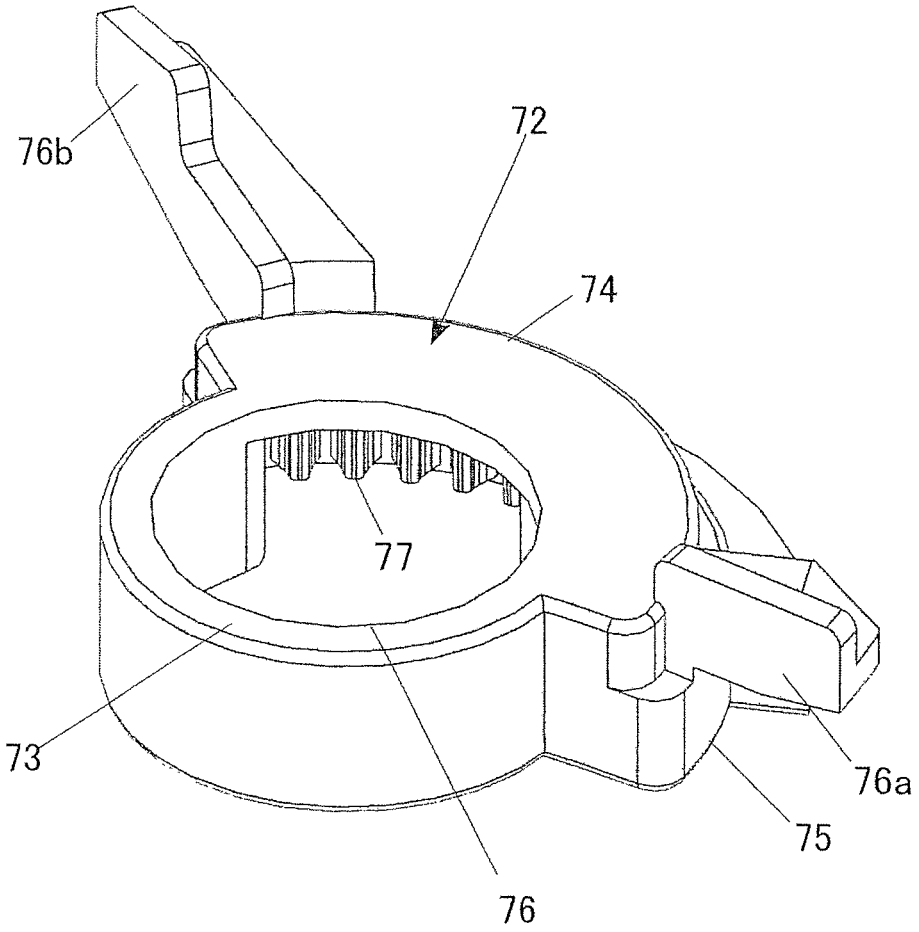
FIG. 7A is a perspective view showing a state of a rotary board, obliquely viewed from above, in the robot-toy body shown in FIG. 2.
Figure 7B:
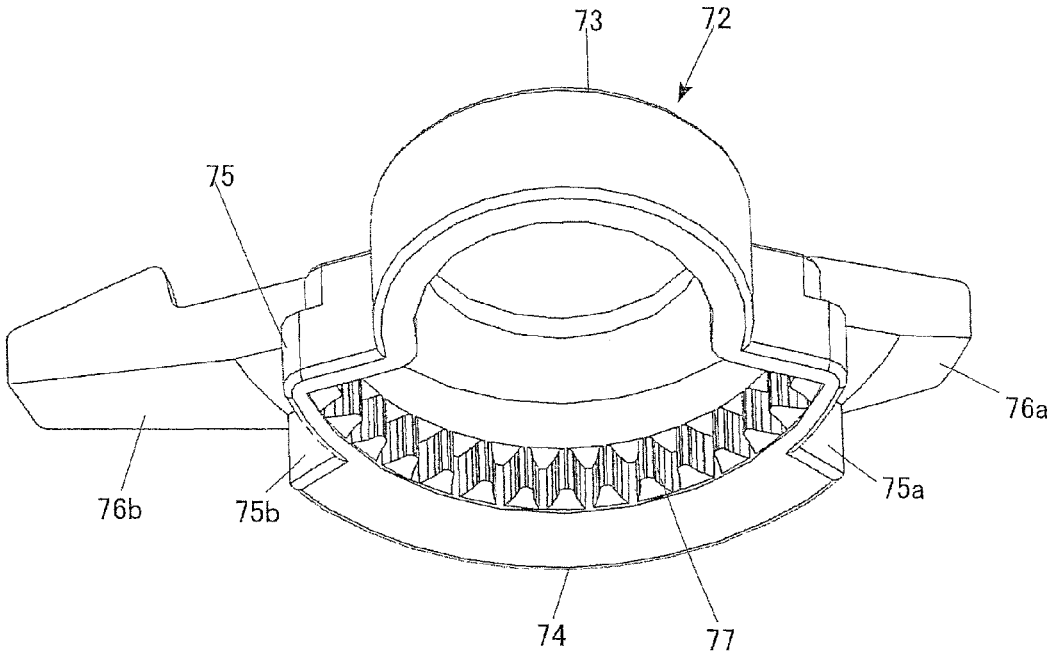
FIG. 7B is a perspective view showing a state of the rotary board, obliquely viewed from below, in the robot-toy body shown in FIG. 2.

FIG. 7A is a perspective view of the rotary board 72 viewed obliquely from above, and FIG. 7B is a perspective view of the rotary board 72 viewed obliquely from below.

The rotary board 72 includes a small-radius section 73 in the front, a large-radius section 74 in the rear, and a stepped section 75 in the middle, the radius of the stepped section 75 being gradually increased to connect the small-radius section 73 with the large-radius section 74.

A circular opening 76 is provided in the front part of the rotary board 72, and the body of the motor 70 lies through the circular opening 76. The rotary board 72 can rotate around the body of the motor 70 serving as a shaft.

A left-end wall of the large-radius section 74 composes a left-lever operation touching unit 75*a*, and a right-end wall composes a right-lever operation touching unit 75*b*. When the rotary board 72 rotates clockwise in a planer view, the left-lever operation touching unit 75*a* touches the left lever 42 from behind to operate the left lever 42. On the other hand, when the rotary board 72 rotates counterclockwise in a planer view, the right-lever operation touching unit 75*b* touches the right lever 42 from behind to operate the right lever 42.

With the rotary board 72, a left input-link-operation touching unit 76*a* and a right input-link-operation touching unit 76*b* are formed on the left and right sides of the stepped section 75, respectively, such that the left input-link-operation touching unit 76*a* and the right input-link-operation touching unit 76*b* protrude outward. When the rotary board 72 rotates clockwise in a planer view, the left input-link-operation touching unit 76*a* touches the left link 27 from the rear to operate the left arm 21*a*. On the other hand, when the rotary board 72 rotates counterclockwise in a planer view, the right input-link-operation touching unit 76*b* touches the right link 27 from the rear to operate the right arm 21*b*.

An internal gear 77 having a semicircular arc shape is arranged below the rotary board 72 across the stepped section 75 and the large-radius section 74.

Figure 8:
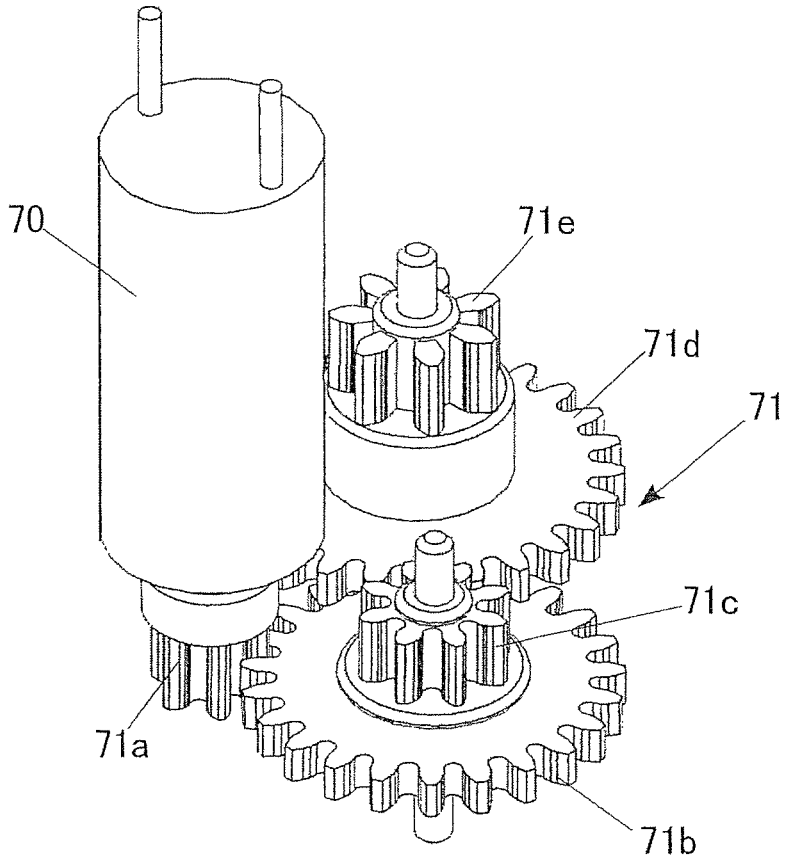
FIG. 8 is a perspective view showing a motor and a gear array in the driving unit of the robot-toy body shown in FIG. 2.

The gear array 71 will now be described. As shown in FIG. 8, the gear 71 includes a gear 71*a* provided on the motor shaft; a large-radius gear 71*b* engageable with the gear 71*a*; a small-radius gear 71*c* integrally formed with the large-radius gear 71*b*; a large-radius gear 71*d* engageable with the small-radius gear 71*c*; a small-radius gear 71*e* engageable with the internal gear 77, which small-radius gear 71*e* is integrally formed with the large-radius gear 71*d*. Having this configuration, the rotary board 72 rotates clockwise or counterclockwise in a planer view in accordance with the direction in which the motor 70 rotates.

5) Head 50

Figure 9:
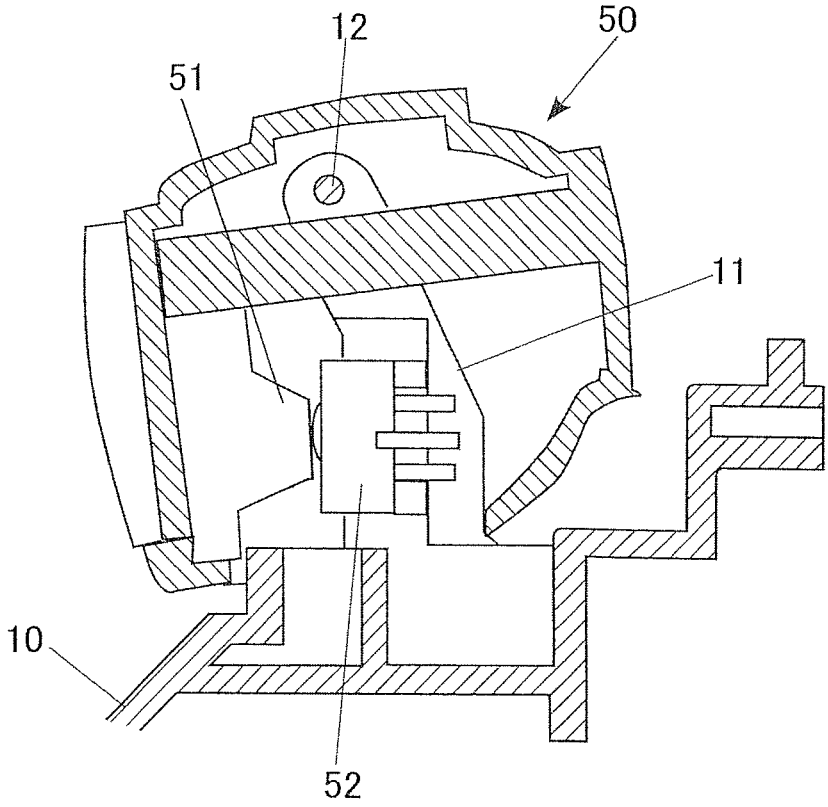
FIG. 9 is a cross-sectional view of the head of the robot-toy body shown in FIG. 2.

As shown in FIG. 9, the head 50 is attached to a bracket 11, which is provided on the upper face of the torso 10, through a shaft 12. The head 50 can swing backward and frontward about the shaft 12.

The shaft 12 supports the upper part of the head 50, and the head 50 stands upright due to its own weight. When the head 50 gets a punch in the face, the head 50 tilts forward. As shown in FIG. 9, when the head 50 tilts forward, and a touching unit 51 in the head 50 hits a push switch 52, and thereby, it is determined that there is a punch in the face. Alternatively, a leaf switch may be used instead of the push switch 52.

Figure 10:
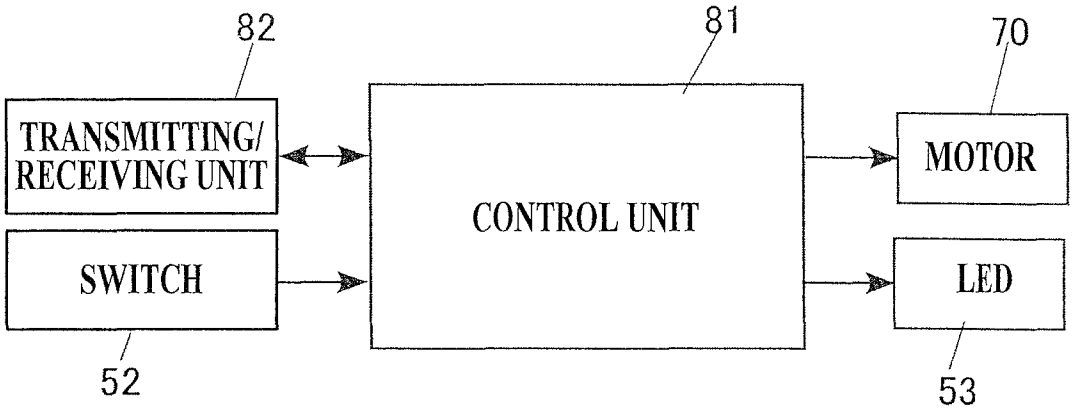
FIG. 10 is a block diagram showing a circuit configuration of the robot-toy body shown in FIG. 2.

An LED (light-emitting diode) 53 is provided inside the face on the head 50 (See FIG. 10). The LED 53 has modes of "on", "flashing", and "off". The LED 53 displays the degree of damage in accordance with the number of punches, for example. The installing location of the LED 53 is not limited to the head 50. The LED 53 may be provided in the torso 10, the arms 20, or the legs 40 to indicate the degree of fatigue or damage of the robot-toy body 100 or each body part. In a case where the robot toy is provided with a weapon or tool, the LED 53 may be provided on the weapon or tool.

(6) Circuit Configuration

FIG. 10 shows a circuit configuration of the robot-toy body 100. The robot-toy body 100 includes a control unit 81, a transmitting/receiving unit 82, the motor 70, the push switch 52, and the LED 53. The control unit 81 receives an operation-control signal from the controller 200 via the transmitting/receiving unit 82. In response to the operation-control signal, the motor 70 controls the movement of the robot-toy body 100. The control unit 81 receives a signal from the push switch 52, and controls lighting of the LED 53 and controls operation of the motor 70 in accordance with the number of punches the body has received. The control unit 81 transmits a signal indicating that the body gets punched to the controller 200 via the transmitting/receiving unit 82 every time the robot-toy body 100 receives a punch.

Every time the left operating unit 210 or the right operating unit 220 of the controller 200 is shaken once, the control unit 81 activates the motor 70 for a certain time necessary for throwing a punch and forwarding the robot-toy body 100, and subsequently stops the motor 70.

2. Configuration of Controller 200

As shown in FIG. 1, the controller 200 includes the left operating unit 210 and the right operating unit 220. Each of the left operating unit 210 and the right operating unit 220 is a size that can be held by one hand. The left operating unit 210 and the right operating unit 220 are electrically connected to a cable 229.

Figure 11:
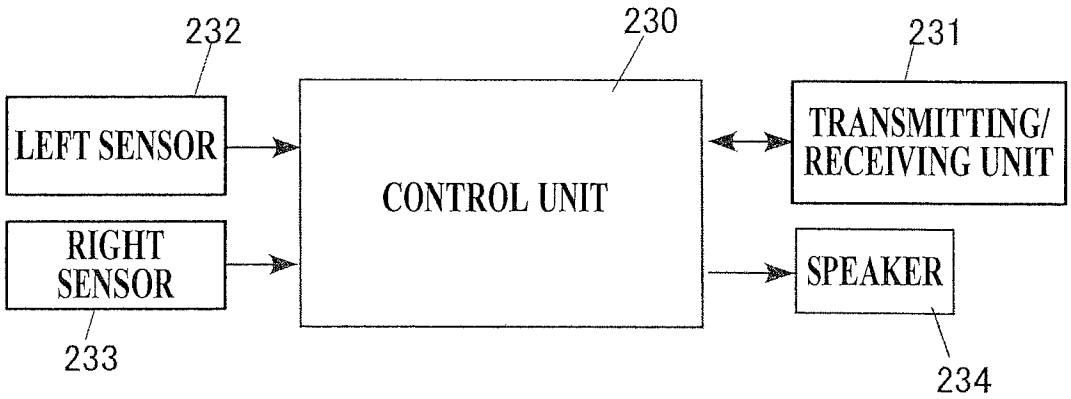
FIG. 11 is a block diagram showing a circuit configuration of a controller of the robot toy shown in FIG. 2.

FIG. 11 shows a circuit configuration of the controller 200. The controller 200 includes a control unit 230, a transmitting/receiving unit 231, a left sensor 232, a right sensor 233, and a speaker 234. The control unit 230, the transmitting/receiving unit 231, the right sensor 233, and the speaker 234 are provided in the right operating unit 220, whereas the left sensor 232 is provided in the left operating unit 210. It should be noted that the transmitting/receiving unit 231 and the speaker 234 may be provided in the left operating unit 210.

When the left sensor 232 detects shaking of the left operating unit 210, the control unit 230 generates an operation-control signal for the left side, and transmits the operation-control signal for the left side to the robot-toy body 100 via the transmitting/receiving unit 231. On the other hand, when the right sensor 233 detects shaking of the right operating unit 220, the control unit 230 generates an operation-control signal for the right side, and transmits the operation-control signal for the right side to the robot-toy body 100 via the transmitting/receiving unit 231.

When the control unit 230 receives a signal, which indicates that the robot-toy body 100 gets a punch, from the robot-toy body 100 via the transmitting/receiving unit 231, the control unit 230 outputs a punching sound or the like through the speaker 234 in response to the signal.

The controller 200 may include a recharger for the robot-toy body 100.

3. Action of the Body 100

(1) In Case where Left Operating Unit 210 is Operated:

(Action of Legs 40)

The rotary board 72 rotates clockwise in a planer view, and the left-lever operation touching unit 75*a* in the rotary board 72 comes into contact with the upper end portion of the left lever 42 from behind to push out the upper end portion of the left lever 42 frontward. Then, the lever 42 rotates counterclockwise in FIG. 5A against the biasing force of the spring 44. At this time, the click 47*a* of the catch 47 in the lever 42 is engaged with a tooth of the toothed wheel 46 to lock the front wheel 45. Thus, the front wheel 45 pushes against the floor so that the left leg 41*a* moves forward.

Since the right-lever operation touching unit 75*b* in the rotary board 72 does not come into contact with the upper end portion of the right lever 42, the right leg 41*b* does not so much move forward; however, due to the rear wheel 48 in the right leg 41*b*, the right leg 41*b* moves forward to some extent.

The left lever 42 returns to its original position due to the biasing force of the spring 44 after the motor 70 stops moving.

(Action of Arms 20)

The left input-link-operation touching unit 76*a* in the rotary board 72 comes into contact with the link 27 from behind, thereby pushing the link 27 forward. Consequently, the link 27 allows the upper arm 23 and the lower arm 24 to move forward against the biasing force of gravity, whereby the body throws a punch with the left arm 21*a*.

At this time, since the right input-link-operation touching unit 76*b* in the rotary board 72 does not come into contact with the right link 27, the right arm 21*b* does not move due to its own weight.

The left arm 21*a* returns to its original position due to its own weight after the motor 70 stops moving.

(2) In Case where Right Operating Unit 220 is Operated:

(Action of Legs 40)

The rotary board 72 rotates counterclockwise in a planer view, and the right-lever operation touching unit 75*b* in the rotary board 72 comes into contact with the upper end portion of the right lever 42 from behind to push forward the upper end portion of the right lever 42. Consequently, the right lever 42 rotates counterclockwise in FIG. 5A against the biasing force of the spring 44. At this time, the click 47*a* of the catch 47 in the lever 42 is engaged with a tooth of the toothed wheel 46, thereby locking the front wheel 45. Thus, the front wheel 45 pushes against the floor so that the right leg 41*b* moves forward.

Since the left-lever operation touching unit 75*a* in the rotary board 72 does not come into contact with the upper end portion of the left lever 42, the left leg 41*a* does not so much move forward; however, due to the rear wheel 48 in the left leg 41*a*, the left leg 41*a* moves forward to some extent.

The right lever 42 returns to its original position due to the urge of the spring 44 after the motor 70 stops moving.

(Action of Arms 20)

The right input-link-operation touching unit 76*b* in the rotary board 72 comes into contact with the right link 27 from behind, thereby pushing the right link 27 forward. Consequently, the right link 27 allows the upper arm 23 and the lower arm 24 to move forward against the biasing force of gravity, whereby the body throws a punch with a right arm 21*b*.

At this time, since the left input-link-operation touching unit 76*a* in the rotary board 72 does not come into contact with the left link 27, the left arm 21*a* does not move due to its own weight.

The right arm 21*b* returns to its original position due to its own weight after the motor 70 stops moving.

According to the robot toy, when a punch is thrown, the lever 42 in the thrust mechanism B pushes against the floor and the leg on the same side as the arm that has thrown the punch moves forward. As a result, the moving direction of the robot-toy body can be controlled easily.

Furthermore, according to the robot toy, when the bottom half portion of the lever 42 moves from the front to the back, the front wheel 45 is locked. As a result, the robot-toy body 100 can effectively move forward by pushing against the floor. On the other hand, when the bottom half portion of the lever 42 moves from the back to the front, the front wheel 45 is released and rolls, which halts the robot-toy body 100. Thus, the advance movement of the robot-toy body 100 is ensured.

According to the robot toy, the rotary board 72 rotates about a shaft (the body of the motor 70), which extends vertically just below the torso 10. Thereby, the levers 42 move by being touched by the left-lever operation touching unit 75*a* and the right-lever operation touching unit 75*b* formed on the periphery of the rotary board 72. As a result, one push of the levers 42 allows the robot-toy body 100 to move forward by a long distance.

Moreover, according to the robot toy, the rotary board 72 actuates not only the thrust mechanism B but also the arm actuating mechanism A, which allows the structure of the driving unit C to be simple.

Furthermore, according to the robot toy, the body assumes a ready position where the left and right arms 21*a* and 21*b* are bent due to their own weights in a normal condition. This eliminates the need for a biasing means, such as a spring, to make the ready position, which allows the structure of the robot-toy body 100 to be simple.

6. Modification of the Present Invention

The robot toy of the present invention is not limited to the embodiments described above, and various changes may be made within the scope of the present invention.

Although the robot toy is constructed to throw a punch in the above embodiment, the robot toy may throw a slaps in sumo wrestling.

Further, although the LED 53 has the modes of "on", "flashing", and "off" in the above embodiment, variations of lighting color may be employed in place of, or in addition to these three modes. With a variation of lighting color, a robot toy and an opponent robot toy may easily be distinguished by the color in a play fighting.

Moreover, the way of playing may include different variations.

For example, three or more robot-toy bodies 100 may play tag.

Specifically, red is assigned to a robot-toy body 100 of "it", and blue is assigned to the other robot-toy bodies 100. When a robot-toy body 100 with a blue light gets punched, the color of the robot-toy body 100 which has been punched turns red. The last robot-toy body 100 with a blue light wins. Alternatively, in the tag, red is assigned to a robot-toy body 100 of "it", and blue is assigned to the other robot-toy bodies 100. When the robot-toy body 100 with a blue light gets punched, the color of the robot-toy body 100 which has been punched turns red, and the color of the robot-toy body 100 that has thrown the punch turns blue.

The invention claimed is:

1. A robot toy comprising:

a robot-toy body including a control unit; and a controller which remotely controls the robot-toy body via the control unit wherein the robot-toy body includes:

right and left arms each connected to a torso, wherein states of each of the right and left arms include a state of being extended forward and being pulled back, and wherein each of the right and left arms is pulled back by a predetermined biasing force in a normal condition;

right and left legs each connected to a hip;

right and left arm-actuating mechanisms provided at the right and left arms, respectively, wherein each of the arm-actuating mechanisms allows the corresponding arm to be extended forward of the robot-toy body against the biasing force;

right and left thrust mechanisms provided at the right and left legs, respectively, wherein each of the thrust mechanisms allows the corresponding leg to push against a support so that the leg moves forward; and a driving unit which simultaneously drives the left arm-actuating mechanism and the left thrust mechanism as a first pair, and simultaneously drives the right arm-actuating mechanism and the right thrust mechanism as a second pair, wherein the driving unit drives one or the other of the first and second pairs at a time, wherein each of the right left arms includes an upper arm and a lower arm which are bent and stretched with respect to each other;

when the right and left arms are pulled back, the upper arm and the lower arm of each of the right and left arms are bent with respect to each other, so that the robot-toy body assumes a ready position;

when one of the right and left arms is extended forward, the upper arm and the lower arm of the extended arm are stretched with respect to each other;

each of the thrust mechanisms includes a lever extending vertically in an interior of the corresponding leg, the lever being supported rotatably with a shaft such that a bottom end portion of the lever moves back and forth;

a wheel provided at the bottom end portion of the lever; and a clutch mechanism which engages the wheel when the bottom end portion of the lever moves backward, and which releases the wheel when the bottom end portion of the lever moves forward; and wherein a movement of the lever allows the corresponding leg to move forward.

2. The robot toy according to claim 1, wherein the driving unit comprises a rotary member which is rotatable about a shaft vertically extending below the torso, the rotary member including right and left lever-operation touching units corresponding to the right and left levers, respectively; and when one of the right and left levers is touched by the corresponding lever-operation touching unit, the touched lever moves.

3. The robot toy according to claim 2, wherein each of the arm-actuating mechanisms includes a four-bar linkage mechanism including a supporting unit, the upper arm, the lower arm, and a link, wherein the supporting unit supports the upper arm, wherein the link is disposed between the supporting unit and the lower arm, and wherein one of the upper arm and the link serves as an input link;

the rotary member includes right and left input-link-operation touching units corresponding to the right and left input links, respectively; and when one of the right and left input links is touched by the corresponding input-link-operation touching unit, the touched input link moves.

4. The robot toy according to claim 1, wherein the predetermined biasing force is the arm's own weight; and in the normal condition, the robot-toy body assumes a ready position where each of the right and left arms is bent due to its own weight.

5. The robot toy according to claim 2, wherein the predetermined biasing force is the arm's own weight; and in the normal condition, the robot-toy body assumes a ready position where each of the right and left arms is bent due to its own weight.

6. The robot toy according to claim 3, wherein the predetermined biasing force is the arm's own weight; and in the normal condition, the robot-toy body assumes a ready position where each of the right and left arms is bent due to its own weight.

* * * * *